US006126404A

United States Patent [19]

Schär et al.

[11] Patent Number: 6,126,404

[45] Date of Patent: Oct. 3, 2000

[54] APPARATUS FOR THE METERED DELIVERY OF FLUIDS

[75] Inventors: Heinrich Schär, Studen; Jürg Burri, Stutz; Eckhard Swirner, Cudrefin, all of Switzerland

[73] Assignee: Saphirwerk Industrieprodukte AG, Brugg b Biel, Switzerland

[21] Appl. No.: 09/090,322

[22] Filed: Jun. 4, 1998

[30] Foreign Application Priority Data

Jun. 9, 1997 [CH] Switzerland ..... 1388/97

[51] Int. Cl.[7] ..... F04B 49/00

[52] U.S. Cl. ..... 417/216; 222/383.2

[58] Field of Search ..... 222/309, 334, 222/340, 383.2; 417/216

[56] References Cited

U.S. PATENT DOCUMENTS

| | | | |
|---|---|---|---|
| 3,590,813 | 7/1971 | Roszyk | 222/340 |
| 4,212,596 | 7/1980 | Ruseff | 417/216 |
| 4,770,613 | 9/1988 | Hoover et al. | 222/383.2 |
| 4,983,103 | 1/1991 | Ogawa | 222/334 |

*Primary Examiner*—Philippe Derakshani
*Attorney, Agent, or Firm*—Bachman & LaPointe, P.C.

[57] ABSTRACT

A metering apparatus for delivery of a metered amount of fluid includes an axial piston pump and a rotary drive having an output, a coupling for connecting the rotary drive output to a piston of the axial piston pump wherein said piston is cardanically connected to said coupling.

3 Claims, 3 Drawing Sheets

APPARATUS FOR THE METERED DELIVERY OF FLUIDS

BACKGROUND OF THE INVENTION

The invention concerns an apparatus for the metered delivery of fluids, as set forth in the classifying portion of claim 1.

Apparatuses for the metered delivery of media which are capable or being delivered, such as a fluid, are also referred to for the sake of brevity as 'metering pumps'. In contrast to continuous-flow pumps which for example physically displace quantities of fluid in a continuous flow, the function of metering pumps lies in making delivery media available in given amounts, that is to say metered quantities, at fixed intervals of time. A distinction is made in relation to pumps of that kind between valved metering pumps and valve-less metering pumps, with the valve-less metering pumps being in the forefront for dealing with small amounts, that is to say small metered quantities. The present invention is concerned with metering pumps of the latter kind (referred to hereinafter as pumps for the sake of brevity).

In such pumps, the actual delivery unit, usually a piston-cylinder unit, has to perform two functions, firstly the function of providing for pure delivery and secondly measuring out the discharged metered amounts. The delivery action is effected by axial displacement of the piston (stroke movement) and the measuring-out function is achieved, utilising the stroke movement, by virtue of rotation (stroke movement+rotation) of tile piston, with which inlet and outlet openings or ports in the cylinder are respectively opened and closed. The rotary movement of the piston is effected by means of a rotary drive and the stroke movement is produced by way of a sensing or follower pin which follows a control cam during the rotary movement.

A known pump includes a piston-cylinder unit with inlet and outlet extending transversely with respect to the axial direction, and a piston which is rotatable and axially slidable in the cylinder. The end of the piston which projects out of the cylinder is accommodated in a coupling which in turn co-operates with a rotary drive. On its end face which is towards the cylinder, the coupling carries the pin which follows the control cam. In that way the coupling is displaced axially by the same distance as the piston. The control ram (referred to hereinafter as the slide face) is arranged at the annular end face of the cylinder which is disposed in opposite relationship to the coupling and over which the pin then passes (the end face is normally ground and lapped at an angle of 1.5 degrees).

In the known pump, it is already possible to find severe amounts of wear at the sealing surface of the piston after a relatively short period of time. Such wear phenomena are due to a lateral piston pressure which in turn results from the rigid connection of the piston to the pin (referred to hereinafter as the slide shoe). The arrangement of the slide face on the cylinder by grinding and lapping same is complicated and expensive from the production procedure point of view, and in the event of the slide face exhibiting wear phenomena, the cylinder has to be replaced as an entire and expensive unit. Forming the slide face on the end face of the cylinder incurs the further disadvantage that wetting of the slide face with fluid to be delivered, possibly issuing from the cylinder bore due to the sealing conditions involved, is not impossible. Such wetting results in contamination and soiling of the slide face and, in the case of aggressive fluids being delivered, it results in damage to or destruction or the slide shoe. The angle at which the slide face is disposed for example relative to the outer peripheral wall of the cylinder (skew or bevel angle) determines the stroke length or travel or the piston in the cylinder and, over travel distances of different lengths, the delivery range of the known pump. The known pump does not lend itself to conversion to smaller or larger amounts of delivery media, as for that purpose at least the cylinder but in most cases the entire piston-cylinder unit would have to be replaced, with a modified slide face angle.

It is known that, in the case of a pump of the known kind, the viscosity of the delivery medium and the speed or rotation of the piston determine the delivery amount per revolution (that is to say the metered amount delivered). With the speeds of rotation remaining the same and with the viscosity being unchanged, the delivery amount per revolution is constant. Constancy in terms of delivery amount is an important operational criterion for pumps of the kind referred to herein.

In consideration of the electrical power supply to the rotary drive, speeds of rotation of the piston can fluctuate, while the viscosity of the medium being conveyed can also change, for example under the influence of temperature. The known pump does not provide any means for being able to make adjustments during operation of the pump to keep the amounts delivered per revolution constant.

Taking the known pump as its basic starting point, the object of the present invention is to provide a pump which constitutes a development in relation to the known pump, and that object is attained by a pump having the features of the claims individually or in combination.

BRIEF DESCRIPTION OF THE DRAWINGS

Further features, advantages and details of the invention will be apparent from the following description of a preferred embodiment and the drawing in which.

DETAILED DESCRIPTION

Figure 1:
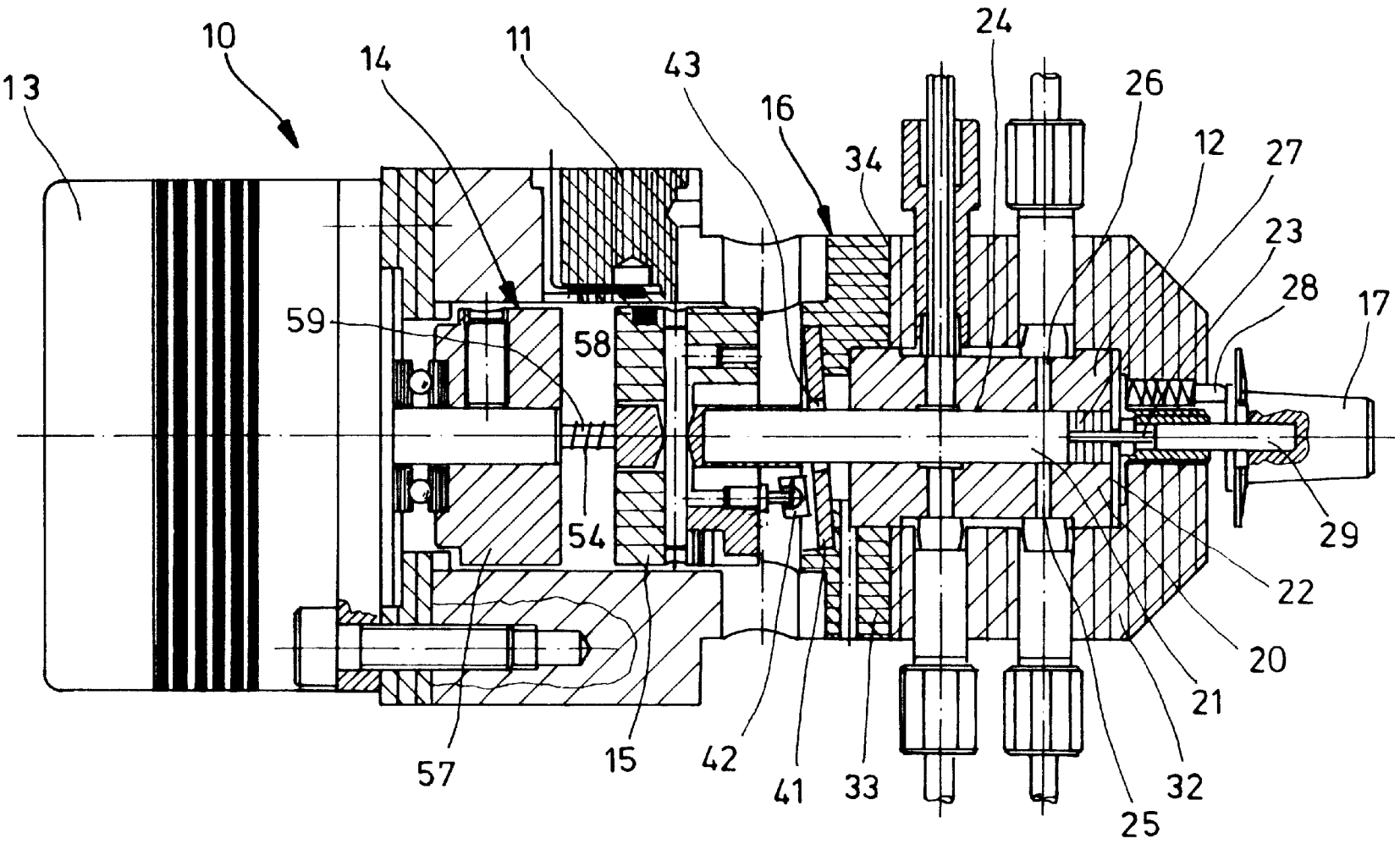
FIG. 1 is a partly sectional view of a pump designed in accordance with the invention.

Referring to FIG. 1 the pump 10 according to the invention comprises a housing 11, an axial piston pump 12 accommodated in the housing, a rotary drive 13 arranged on the housing 11 with a drive output arrangement 14 accommodated in the housing 11, and acoupling 15 which is equally accommodated in the housing and which connects the axial piston pump 12 to the drive output arrangement 14. Provided between the axial piston pump 12 and the coupling 15 is a control device 16 which produces stroke movements in the axial piston pump 12. Co-operating with the axial piston pump 12 is an adjusting device 17 with which the delivery or feed quantity of the pump 10 according to the invention can be regulated. The axial piston pump 12 (a piston-cylinder unit) includes a cylinder 10 with a piston 21 which is rotatably and axially slidably accommodated in its internal bore 24. The cylinder 10 is closed at one end by means of a cylinder cover 22 through which there only passes an adjusting pin 23 of the adjusting device 17, in sealed relationship, with the adjusting pin 23 projecting into the internal bore 24. In the proximity of the cylinder cover 22, that is to say at the end towards the cover, two bores which are disposed on a diametral line pass through the cylinder 20. Of those bores, the bore identified by reference numeral 25 is the suction intake bore while the bore identified by reference numeral 26 is the outlet bore. The bores 25, 26 are connected to connecting devices for feed and discharge lines for media being conveyed. A second set of bores with connecting devices (not referenced) serve for ending operation of the pump or, upon a change in materials being conveyed, for cleaning of the pump by flushing. The piston 21 which is axially slidably and rotatably accommodated in the internal bore 24 in the cylinder 20 is provided at one side at its end towards the cover 22 with an opening 27. The opening 27 is in practice in the form of a step comprising a surface which extends from the end of the piston 21 towards the cover and parallel to the longitudinal axis of the piston 21, and a surface which is perpendicular to the longitudinal axis. The length of the surface which extends parallel to the longitudinal axis is such that in any axial position of the piston it intersects the plane of the two hores 25, 26. The side edges or the opening 2/ alternately open and close the bores 25, 26, for which reason this is referred to as an edge control. Preferably the axial piston pump 12, that is to say the cylinder 20 and the piston 21, is made from a ceramic material. As such, aluminum oxide has proven its worth, or, for specific pump uses, zirconium oxide or sapphire. The adjusting pin 23 of the adjusting device bears at one end against the surface of the opening 27, which extends perpendicularly to the longitudinal axis of the piston 21, and at the other end it is connected to a detent-locked (locking detent 28) adjusting member 29 of the adjusting device 17.

The piston 21 is axially displaced by actuation of the adjusting member 29, which with the described edge control acts directly on the delivery amount. The adjusting device provided in accordance with the invention permits adjustment of the delivery amount, that is to say delivery amount regulation of +/− 30%. The regulation effect which can be implemented by means of the adjusting device 17 resolves on the one hand the problem of fluctuations in the delivery volume (caused by fluctuating speeds of rotation and/or viscosities) in the case of pumps without adjusting devices of the kind described and claimed (state of the art), while on the other hand it enlarges the area of use of a pump designed in accordance with the invention, insofar as therewith it is possible to adjust a given nominal delivery rate involving smaller or larger delivery amounts, without the axial piston pump 12 having to be replaced for that purpose, as has to be done in the state of the art. To illustrate this by way of example, this means that a pump provided with a regulating system in accordance with the invention (for example a micro-metering pump) with a nominal delivery rate of 30 $\mu$l can be adjusted to delivery amounts of between 20 $\mu$l and 40 $\mu$l.

The axial piston pump 12, that is to say its cylinder 20, is partially accommodated at the cover end in a housing portion 32 of which one end wall carries the adjusting device 17 while another housing portion 33 adjoins its end face which is towards the coupling end (coupling 15).

Figure 2:
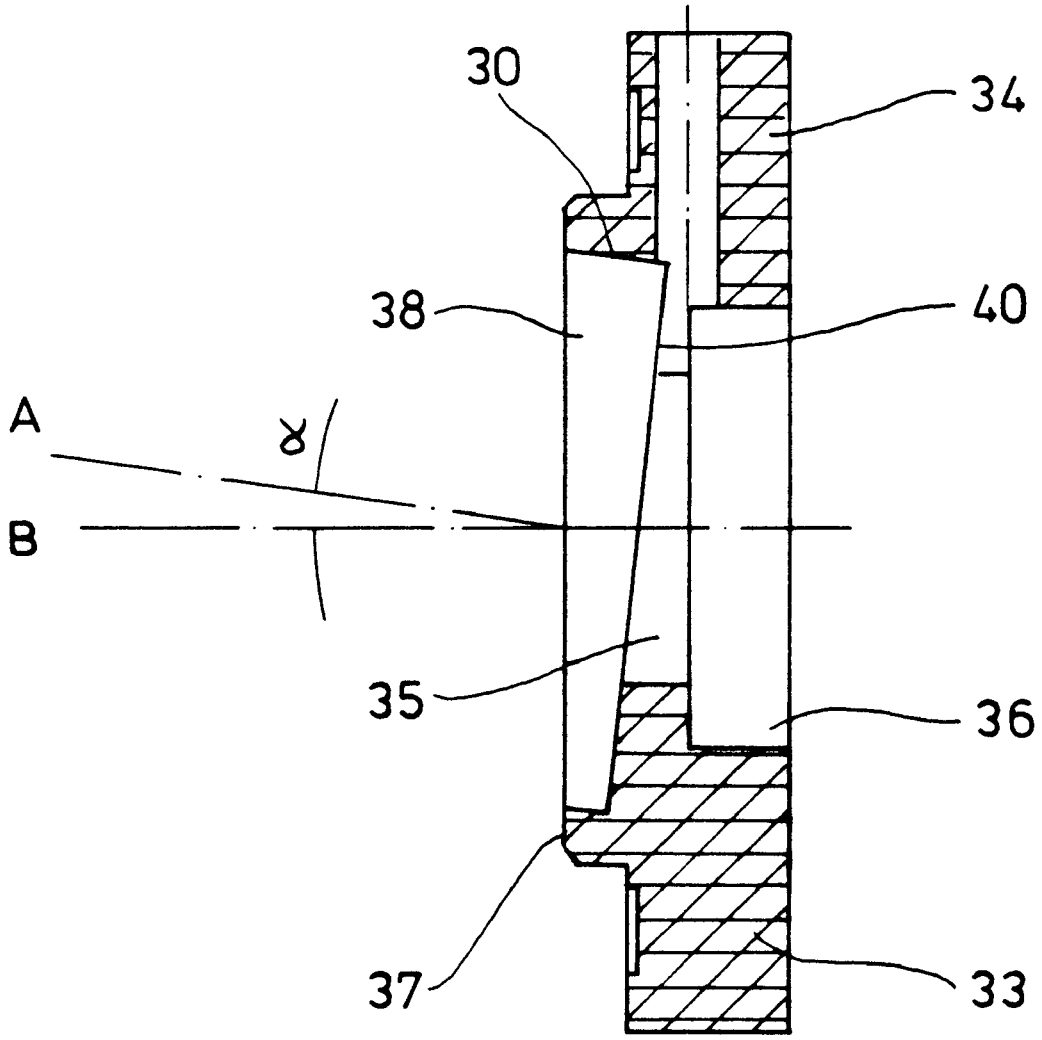
FIG. 2 shows a detail from FIG. 1, a control housing.

The housing portion 33 (referred to hereinafter as the control housing cam 33) is shown in the form of an individual component in FIG. 2. It is a rotationally symmetrical cylindrical body with an axially extending opening 35 and a first face 34 which extends at a right angle to the longitudinal axis starting from the end face 34, the opening 35 is enlarged in the form of a stepped opening portion 36 which is formed by learning and in which an end, that is to say the end of the cylinder 20 towards the coupling, is accommodated. When the housing portions 32 and 33 are brought into engagement with each other at their faces, the cylinder is then accommodated in the housing portions 32, 33 while the piston 21, engaging through the opening 35, projects from the control housing 33 towards the coupling 15. Equally, a stepped opening 38 extends from a second face 37 which is in opposite relationship to the first face 34, with the faces 34 and 37 extending in mutually parallel relationship. The longitudinal axis of the stepped opening 38, as indicated at A, is at an angle $\alpha$ relative to the longitudinal axis B of the control housing. The peripheral wall 39 and the bottom 40 are therefore at predetermined angles relative to the longitudinal axis of the control housing 33, wherein the peripheral wall 39 and the bottom 10 of the opening 38 extend at a right angle to each other. As shown in FIG. 1, accommodated in the opening 38 is a stationarily disposed control disc 41 which, together with a slide shoe 42, the latter being arranged on the rotating coupling 15 to move therewith, form the essential elements of the control arrangement 16, for determining the stroke movement of the piston 21. The cylindrical control disc 41 which is provided with parallel faces and which, after being fitted into the opening 38, is disposed with its faces (one thereof becomes the control face) and its peripheral wall at the same angle $\alpha$ relative to the longitudinal axis of the control housing 33 as the bottom 40 and the peripheral wall 39, has a central axial bore 43 through which the piston 21 passes in aligned relationship.

In accordance with the invention, there is provided a control disc 41 having a control face, which disc is accommodated in a control housing 33. In that way the control face is separated from the cylinder, in accordance with the invention. Furthermore, the control disc 41 is held axially at a spacing C relative to the end face of the cylinder 20, which is towards the coupling, by means of the control housing 33. That arrangement provides for the following advantages over a conventional pump. The expensive procedure of forming the control face at the end face of the cylinder is eliminated, insofar as the operation of directly forming the control face on the face of the cylinder is replaced by the structure involving the control housing 33 with control disc 41, which is substantially simpler from the production procedure point of view and less expensive. The material pairing of the control disc 41 and the slide shoe 42 can be easily optimised. A preferred material pairing involves ceramic for the control disc 41 and plastic material for the slide shoe 42 in order in that way to approximate to self-lubrication. If the control face exhibits wear phenomena, only the control disc 41 has to be replaced. Wetting of the control face, upon fluid being delivered issuing from the cylinder, is prevented by virtue of the spaced arrangement of the control disc relative to the cylinder 20, that is to say the face thereof. Wear of the slide shoe by virtue of aggressive media being delivered is avoided thereby.

Figure 3:
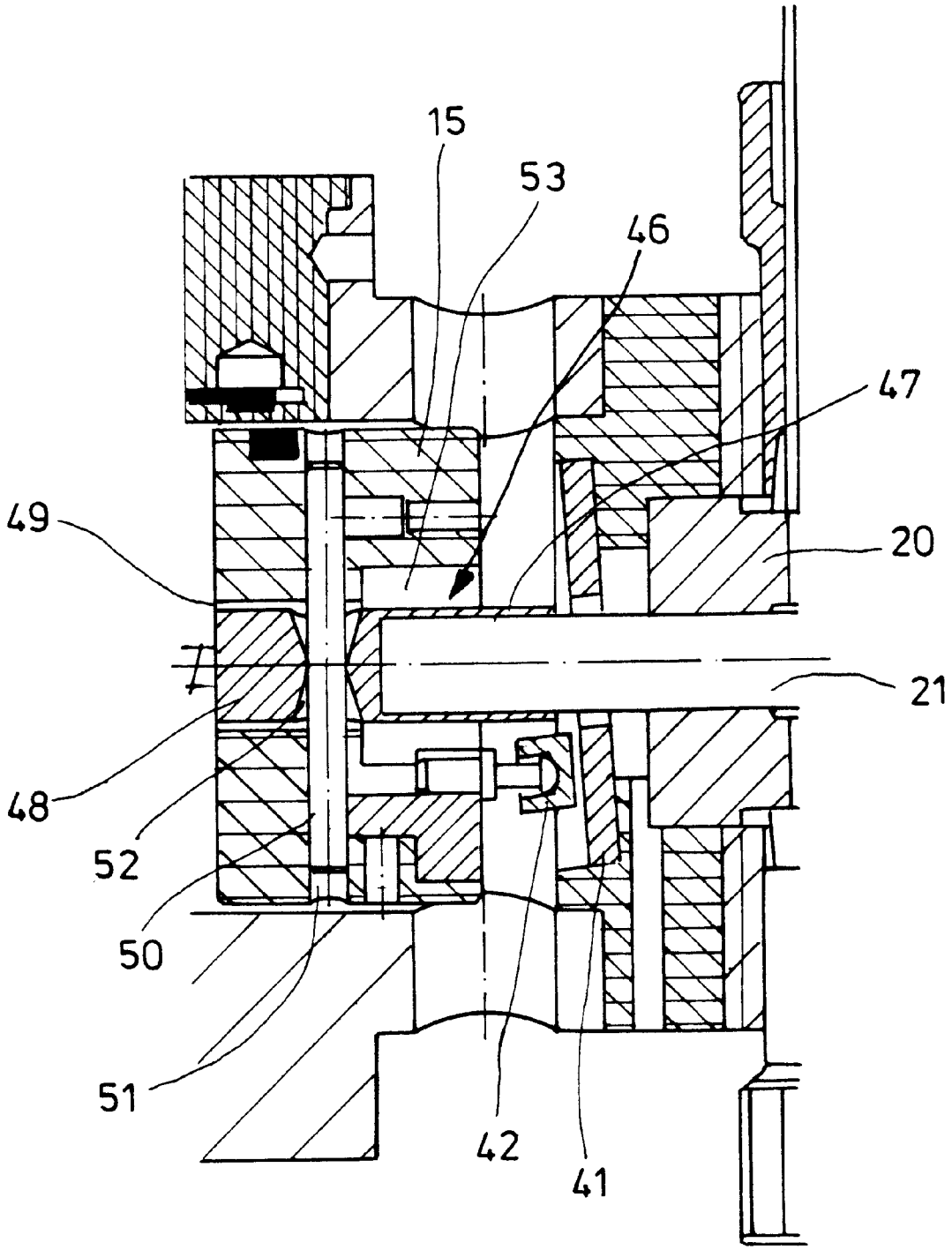
FIG. 3 shows a detail from FIG. 1, a coupling.

The pump designed in accordance with the invention makes it possible to list it as a so-called basic pump for setting given delivery amounts from a range of delivery amounts which is desirable from the point of view of a user, which was not possible in contrast with known pumps. Desired delivery amounts from the range in question can be easily adjusted by replacing the control housing and the control disc, in which case the latter are to be disposed at an angle $\alpha$ relative to the control housing 33, said angle being specific for the delivery amount concerned. That is also prompted by virtue of the relatively low costs for individualised control housings 33 with control discs 41, which are specific to respective delivery amounts. The pump according to the invention can be characterised by replacement or the control housing 33 with control disc 41 by a simple delivery amount regulation effect, in which respect that can be implemented in quantitative terms by means of the adjusting device 17, when adjustment has been effected. The piston 21 is cardanically connected to the coupling 15, with the free end of the piston which projects from the cylinder 20. Cardanically means that the piston 21 and the coupling 15 rotate without resulting in transverse forces if the axial centre line of the piston 21 and that of the coupling 15 do not coincide in regard to axial extent. For that purpose, as shown in FIG. 3, the end of the piston 21 is pivotably connected by means or a self-aligning or swing bush 16 on the piston 21. The bush 46 includes a tube portion 47 and a head portion 48. The end of the piston 21 is fixedly accommodated in the tube portion 47 while the head portion 48 engages centrally through the coupling 15 in a bore 49. The head portion 40 is fixedly fitted into the bore 49, more specifically by means of a pin 50 which extends transversely with respect to the head portion 48 and which engages through a bore 51 in the body of the coupling 15 and a bore in the head portion 48. The bore 52 is equally conically expanded from both ends or the bore to the centre of the longitudinal extent of the bore 51, so that the pin 50 holds the head portion 48 to the coupling 15 in line contact. As FIG. 3 clearly shows, the diameter of the bore 49 is larger than that of the head portion 48, whereby there is a cylindrical annular space between the bore 49 and the head portion 48, the inside surface of which delimits a movement of the head portion 48 upon deflection of the piston 21, for example perpendicularly to the plane of the drawing. Upon movements in the plane of the drawing the conical or taper surfaces of the enlargement portions afford the required space for pivotal movement, while in this case also the internal surface of the annular space delimits the pivotal movement. The diameter of the bore 49 and that of the head portion 48 and the dimensions of the conical enlargement portions or the bore 51 are such that the coupling 15 can swing freely relative to the piston 21 sufficiently to reduce the transverse force on the piston 21, which is otherwise produced by the slide shoe. At its end which is towards the control disc 41 the coupling 15 is provided with an opening 53 which partially accommodates the bush 46 and the purpose of which is to lighten the coupling 15 and to provide space for swing or pivotal movements of the self-aligning or swing bush 46. At its face which is towards the control face, the coupling, at a spacing relative to its horizontal axis, carries a slide shoe 42 which passes over the control face, in accordance with the selected spacing, biased by means of springs 54, that is to say in contact with and following the control face. With that swinging, that is to say cardanic connection of the piston 21 to the coupling 15 (or vire-versa) the transverse forces (lateral axial pressure) are eliminated, being responsible for the wear between the piston 21 and the cylinder 2O in known pumps.

The coupling in turn is in engagement with the drive output arrangement 14 (flange-mounted to the rotary drive 13). For that purpose the face 58 of a drive output block 57 carries two pins 59 which are arranged eccentrically equidistantly relative to the longitudinal axis of the drive output block 57 on a diametral line and projecting in the direction of the coupling 15. The pins 59 engage slidably into suitably arranged bores (not shown) in the body of the coupling 15 so that the coupling 15 is axially displaceable with a reciprocating movement (oscillating movement) in the housing 60 relative to the drive output arrangement 14 and in a direction towards the control housing 33. The coupling 15 is sprung by means of the springs 54 relative to the drive output arrangement 14 (accommodated in the housing 60), the pins 59 serving as holding means for the springs 54 and carrying the torque which is produced upon rotation of the coupling 15 by the slide shoe 42.

The mode of operation of the pump according to the invention is as follows: when the rotary drive 13 is still and when the piston 21 is in the furthest inwardly displaced position in the cylinder 20, the stepped opening 27 covers the intake bore 25 and the outlet bore 26. With the beginning of rotary movement of the piston 21 the intake bore 25 is opened by the stepped opening 27. At the same time the slide shoe also moves on the control disc 41 which, by virtue of its inclined positioning of for example 1.5 degrees, moves the piston 21 out of the cylinder 20, with corresponding displacement of the coupling 15 in the direction towards the drive output arrangement, compressing the springs 54. That stroke movement produces a vacuum in the pump chamber (if the annular space which has become free in the cylinder 20), and that causes the pump chamber to be filled with medium to be delivered. The intake procedure terminates after about 175 degrees of rotary movement. The slide shoe 42 is disposed directly on the highest point of the control disc 41. Subsequently the piston 21 closes the intake bore 25 and the outlet bore 26 and after a further rotary movement of about 5 degrees the opening 27 opens the outlet bore. Due to the inclined plane on which the slide shoe 42 moves, the piston 21 urges the fluid out of the pump chamber by means of the expansion forces of the springs acting on the coupling 15. At its low point—the piston 21 and the slide shoe 42 are disposed at the lowermost point, the latter on the control disc 41—the pumping-out operation is concluded.

The pump is then in its zero position again.

What is claimed is:

1. A metering apparatus for delivery of a metered amount of fluid comprises:

an axial piston pump;

a rotary drive having an output; and a coupling for connecting said rotary drive output to a piston of said axial piston pump to produce stroke movements in the axial piston pump, said coupling includes a fixed cam including a control disc arranged at a spacing relative to said axial piston pump wherein said piston is cardanically connected to said coupling.

2. Apparatus according to claim 1 characterised in that the delivery amount of the axial pump (12) is variable by changing the control disc (41).

3. Apparatus according to claim 2 characterised in that the delivery amount can be regulated by means of an adjusting device (17).

* * * * *